US010036364B2

(12) United States Patent
Ikeda

(10) Patent No.: US 10,036,364 B2
(45) Date of Patent: Jul. 31, 2018

(54) INTERNAL COMBUSTION ENGINE

(75) Inventor: Yuji Ikeda, Kobe (JP)

(73) Assignee: IMAGINEERING, INC., Kobe-shi (JP)

( * ) Notice: Subject to any disclaimer, the term of this patent is extended or adjusted under 35 U.S.C. 154(b) by 0 days.

(21) Appl. No.: 14/238,079

(22) PCT Filed: Aug. 7, 2012

(86) PCT No.: PCT/JP2012/070073

§ 371 (c)(1),
(2), (4) Date: Apr. 2, 2014

(87) PCT Pub. No.: WO2013/021993

PCT Pub. Date: Feb. 14, 2013

(65) Prior Publication Data

US 2014/0283779 A1 Sep. 25, 2014

(30) Foreign Application Priority Data

Aug. 10, 2011 (JP) ..... 2011-175447

(51) Int. Cl.
*F02B 19/00* (2006.01)
*F02P 23/04* (2006.01)
(Continued)

(52) U.S. Cl.
CPC ..... *F02P 23/045* (2013.01); *F02P 3/02* (2013.01); *F02P 9/007* (2013.01)

(58) Field of Classification Search
CPC ..... F02P 23/045; F02P 9/007; F02P 13/00; F02M 27/04
(Continued)

(56) References Cited

U.S. PATENT DOCUMENTS 4,043,308 A * 8/1977 Cerkanowicz ..... F01N 3/38 123/143 R
4,297,983 A * 11/1981 Ward ..... F02P 23/04 123/193.6
(Continued)

FOREIGN PATENT DOCUMENTS

JP 2007-113570 A 5/2007
JP 2009-221947 A 10/2009
JP 2010-101174 A 5/2010

*Primary Examiner* — Marguerite McMahon
*Assistant Examiner* — James Kim
(74) *Attorney, Agent, or Firm* — Westerman, Hattori, Daniels & Adrian, LLP

(57) ABSTRACT

The present invention aims at effectively emitting an electromagnetic wave to a combustion chamber from an emission antenna in an internal combustion engine that promotes combustion of an air fuel mixture utilizing the electromagnetic wave. The present invention is directed to an internal combustion engine including: an internal combustion engine main body formed with a combustion chamber; and an electromagnetic wave emission device that emits an electromagnetic wave to the combustion chamber from an emission antenna. The internal combustion engine promotes combustion of the air fuel mixture by way of the electromagnetic wave emitted to the combustion chamber. The emission antenna is provided in an insulating member and extends along the partitioning surface. The insulating member is provided on a partitioning surface that partitions the combustion chamber. A ground conductor is provided in the insulating member on a side opposite to the combustion chamber in relation to the emission antenna and is electrically grounded.

6 Claims, 8 Drawing Sheets

(51) Int. Cl.
*F02P 3/02* (2006.01)
*F02P 9/00* (2006.01)

(58) Field of Classification Search
USPC ..... 123/143 B, 536; 701/103, 104
See application file for complete search history.

(56) References Cited

U.S. PATENT DOCUMENTS 4,314,530 A * 2/1982 Giacchetti ..... F02P 23/04 123/143 B
4,416,226 A * 11/1983 Nishida ..... F02P 23/04 123/143 B
4,499,872 A * 2/1985 Ward ..... F01L 13/00 123/344
4,556,020 A * 12/1985 Hickling ..... F02B 51/06 123/143 B
4,726,336 A * 2/1988 Hoppie ..... F02P 23/04 123/143 B
5,027,764 A * 7/1991 Reimann ..... F02D 41/3041 123/143 B
5,211,142 A * 5/1993 Matthews ..... H01T 13/50 123/143 B
6,581,581 B1 * 6/2003 Bebich ..... F02P 23/045 123/536
7,719,476 B2 * 5/2010 Ke ..... H01Q 1/362 343/702
8,424,501 B2 * 4/2013 Storm ..... F02B 23/0654 123/143 B
8,602,005 B2 12/2013 Ikeda
2009/0120394 A1 * 5/2009 Heise ..... H01T 13/44 123/143 B
2009/0229581 A1 9/2009 Ikeda
2015/0337793 A1 * 11/2015 Storm ..... F02P 19/021 123/65 R

* cited by examiner

INTERNAL COMBUSTION ENGINE

TECHNICAL FIELD

The present invention relates to an internal combustion engine that promotes combustion of an air fuel mixture utilizing an electromagnetic wave.

BACKGROUND ART

Conventionally, there is known an internal combustion engine that promotes combustion of an air fuel mixture utilizing an electromagnetic wave. For example, Patent Document 1 discloses an internal combustion engine of this kind.

The internal combustion engine disclosed in Patent Document lincludes an ignition device that causes a plasma discharge to occur by emitting a microwave in a combustion chamber before and/or after ignition of an air fuel mixture. The ignition device generates local plasma by a discharge at an ignition plug so that the plasma is generated in a high pressure field, thereby growing the plasma by the microwave. The local plasma is generated at a discharge gap between a tip end part of an anode terminal and a ground terminal part.

PRIOR ART DOCUMENTS

Patent Documents

Patent Document 1: Japanese Unexamined Patent Application, Publication No. 2007-113570

THE DISCLOSURE OF THE INVENTION

Problems to be Solved by the Invention

Meanwhile, in a conventional internal combustion engine, it has not been considered how to effectively emit an electromagnetic wave to a combustion chamber from an emission antenna.

The present invention has been made in view of the above described circumstances, and it is an object of the present invention, in an internal combustion engine that promotes combustion of an air fuel mixture in a combustion chamber utilizing an electromagnetic wave, to effectively emit the electromagnetic wave to the combustion chamber from an emission antenna.

Means for Solving the Problems

In accordance with a first aspect of the present invention, there is provided an internal combustion engine including: an internal combustion engine main body formed with a combustion chamber; and an electromagnetic wave emission device that emits an electromagnetic wave to the combustion chamber from an emission antenna, the internal combustion engine promoting combustion of an air fuel mixture by way of the electromagnetic wave emitted to the combustion chamber. The emission antenna is provided in an insulating member and extends along the partitioning surface. The insulating member is provided on a partitioning surface that partitions the combustion chamber. An electrically-grounded ground conductor is provided in the insulating member on a side opposite to the combustion chamber with respect to the emission antenna.

In accordance with a second aspect of the present invention, there is provided an internal combustion engine including: an internal combustion engine main body formed with a combustion chamber; and an electromagnetic wave emission device that emits an electromagnetic wave to the combustion chamber from an emission antenna, wherein the internal combustion engine promotes combustion of an air fuel mixture by way of the electromagnetic wave emitted to the combustion chamber. The emission antenna is provided in an insulating member provided on a partitioning surface that partitions the combustion chamber and is formed in a helical shape. An electrically-grounded ground conductor is provided in the insulating member on a side opposite to the combustion chamber with respect to the emission antenna.

EFFECT OF THE INVENTION

According to the present invention, since the ground conductor is provided in the insulating member, it is possible to effectively emit the electromagnetic wave to the combustion chamber from the emission antenna.

BEST MODE FOR CARRYING OUT THE INVENTION

Figure 1:
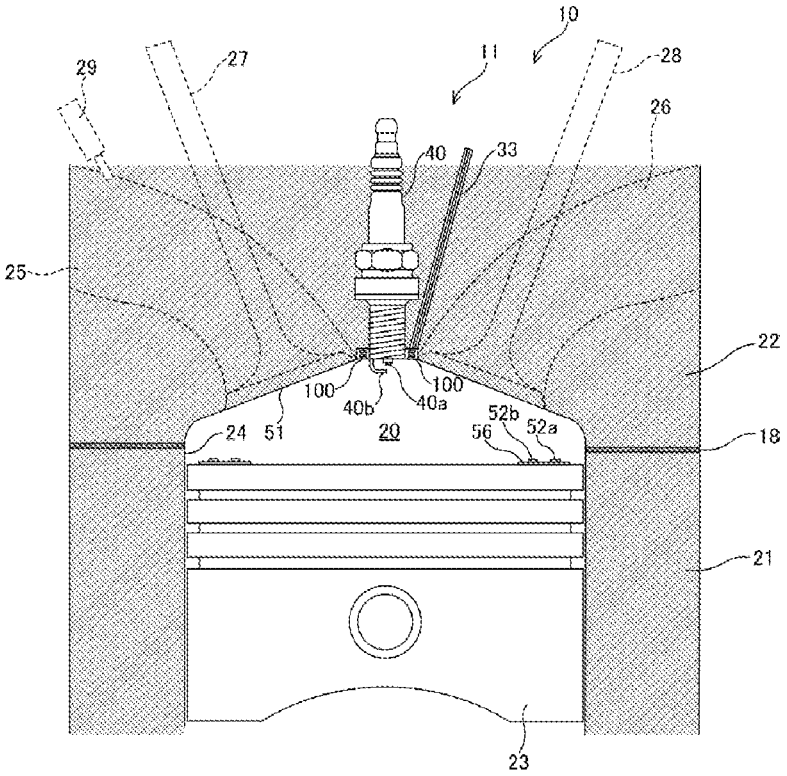
FIG. 1 is a vertical cross sectional view of an internal combustion engine according to an embodiment.

In the following, a detailed description will be given of embodiments of the present invention with reference to drawings. It should be noted that the following embodiments are merely preferable examples, and do not limit the scope of the present invention, applied field thereof, or application thereof.

The present embodiment is directed to an internal combustion engine 10 according to the present invention. The internal combustion engine 10 is a reciprocating type internal combustion engine in which pistons 23 reciprocate. The internal combustion engine 10 includes an internal combustion engine main body 11, an ignition device 12, an electromagnetic wave emission device 13, and a control device 35. In the internal combustion engine 10, a combustion cycle is repeatedly carried out in which an air fuel mixture is ignited and combusted by the ignition device 12.

<Internal Combustion Engine Main Body>

As shown in FIG. 1, the internal combustion engine main body 11 includes a cylinder block 21, a cylinder head 22, and the pistons 23. The cylinder block 21 is formed with a plurality of cylinders 24 each having a circular cross section. Inside of each cylinder 24, the piston 23 is reciprocatably mounted. The piston 23 is connected to a crankshaft (not shown) via a connecting rod (not shown). The crankshaft is rotatably supported by the cylinder block 21. While the piston 23 reciprocates in each cylinder 24 in an axial direction of the cylinder 24, the connecting rod converts the reciprocal movement of the piston 23 to rotational movement of the crankshaft.

The cylinder head 22 is placed on the cylinder block 21, and a gasket 18 intervenes between the cylinder block 21 and the cylinder head 22. The cylinder head 22 constitutes a partitioning member that partitions a combustion chamber 20 having a circular cross section, along with the cylinder 24, the piston 23, and the gasket 18. A diameter of the combustion chamber 20 is, for example, approximately equal to a half wavelength of a microwave emitted to the combustion chamber 20 by the electromagnetic wave emission device 13.

Figure 2:
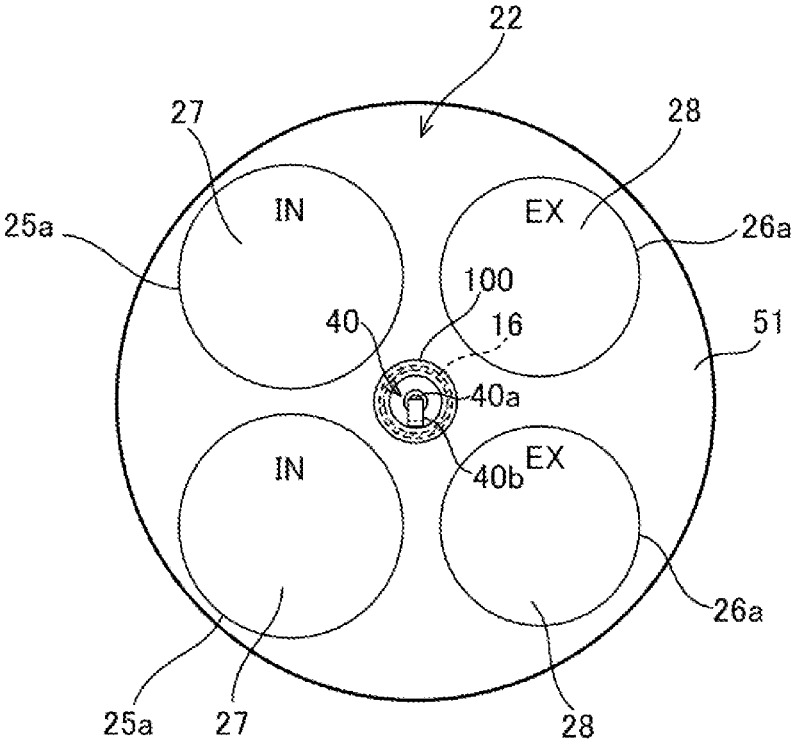
FIG. 2 is a front view of a ceiling surface of a combustion chamber of the internal combustion engine according to the embodiment.

The cylinder head 22 is provided with one ignition plug 40 that constitutes a part of the ignition device 12 for each cylinder 24. As shown in FIG. 2, a tip end part of the ignition plug 40 is exposed toward the combustion chamber 20 and locates at a central part of a ceiling surface 51 of the combustion chamber 20. The ceiling surface 51 is a surface of the cylinder head 22 and exposed toward the combustion chamber 20. An outer periphery of the tip end part of the ignition plug 40 is circular viewed from an axial direction of the ignition plug 40. The ignition plug 40 is provided with a central electrode 40*a* and a ground electrode 40*b* at the tip end part of the ignition plug 40. A discharge gap is formed between a tip end of the central electrode 40*a* and a tip end of the ground electrode 40*b*.

The cylinder head 22 is formed with intake ports 25 and exhaust ports 26 for each cylinder 24. Each intake port 25 is provided with an intake valve 27 for opening and closing an intake side opening 25*a* of the intake port 25, and an injector 29 for injecting fuel. On the other hand, each exhaust port 26 is provided with an exhaust valve 28 for opening and closing an exhaust side opening 26*a* of the exhaust port 26. The internal combustion engine 10 is designed such that the intake ports 25 form a strong tumble flow in the combustion chamber 20.

<Ignition Device>

Figure 3:
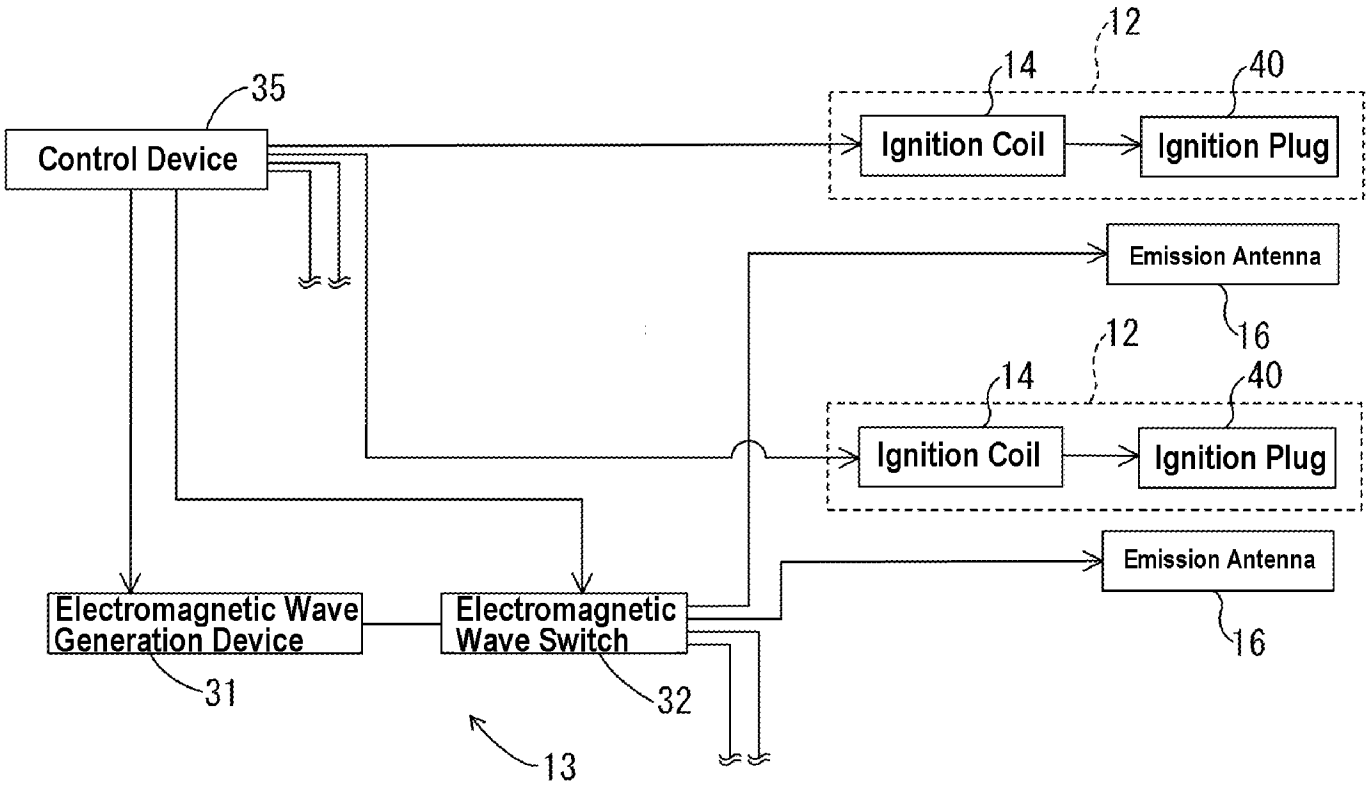
FIG. 3 is a block diagram of an ignition device and an electromagnetic wave emission device according to the embodiment.

The ignition device 12 is provided for each combustion chamber 20. As shown in FIG. 3, each ignition device 12 includes an ignition coil 14 that outputs a high voltage pulse, and the ignition plug 40 which the high voltage pulse outputted from the ignition coil 14 is supplied to.

The ignition coil 14 is connected to a direct current power supply (not shown). The ignition coil 14, upon receiving an ignition signal from the control device 35, boosts a voltage applied from the direct current power supply, and outputs the boosted high voltage pulse to the central electrode 40*a* of the ignition plug 40. The ignition plug 40, when the high voltage pulse is applied to the central electrode 40*a*, causes an insulation breakdown and a spark discharge to occur at the discharge gap. Along a discharge path of the spark discharge, discharge plasma is generated. The central electrode 40*a* is applied with a negative voltage as the high voltage pulse.

The ignition device 12 may include a plasma enlarging part that enlarges the discharge plasma by supplying the discharge plasma with electric energy. The plasma enlarging part enlarges the spark discharge, for example, by supplying the spark discharge with energy of a high frequency such as a microwave. By means of the plasma enlarging part, it is possible to improve stability of ignition even with a lean air fuel mixture. The electromagnetic wave emission device 13 may be utilized as the plasma enlarging part.

<Electromagnetic Wave Emission Device>

As shown in FIG. 3, the electromagnetic wave emission device 13 includes an electromagnetic wave generation device 31, an electromagnetic wave switch 32, and an emission antenna 16. One electromagnetic wave generation device 31 and one electromagnetic wave switch 32 are provided for the electromagnetic wave emission device 13, and the emission antenna 16 is provided for each combustion chamber 20.

The electromagnetic wave generation device 31, upon receiving an electromagnetic wave drive signal from the control device 35, repeatedly outputs a microwave pulse at a predetermined duty cycle. The electromagnetic wave drive signal is a pulse signal. The electromagnetic wave generation device 31 repeatedly outputs the microwave pulse during a period of time of the pulse width of the electromagnetic wave drive signal. In the electromagnetic wave generation device 31, a semiconductor oscillator generates the microwave pulse. In place of the semiconductor oscillator, any other oscillator such as a magnetron may be employed.

The electromagnetic wave switch 32 includes an input terminal and a plurality of output terminals provided for the respective emission antennae 16. The input terminal is connected to the electromagnetic wave generation device 31. Each output terminal is connected to the corresponding emission antenna 16. The electromagnetic wave switch 32 sequentially switches a supply destination of the microwave outputted from the electromagnetic wave generation device 31 from among the plurality of the emission antennae 16 under a control of the control device 35.

Figure 4:
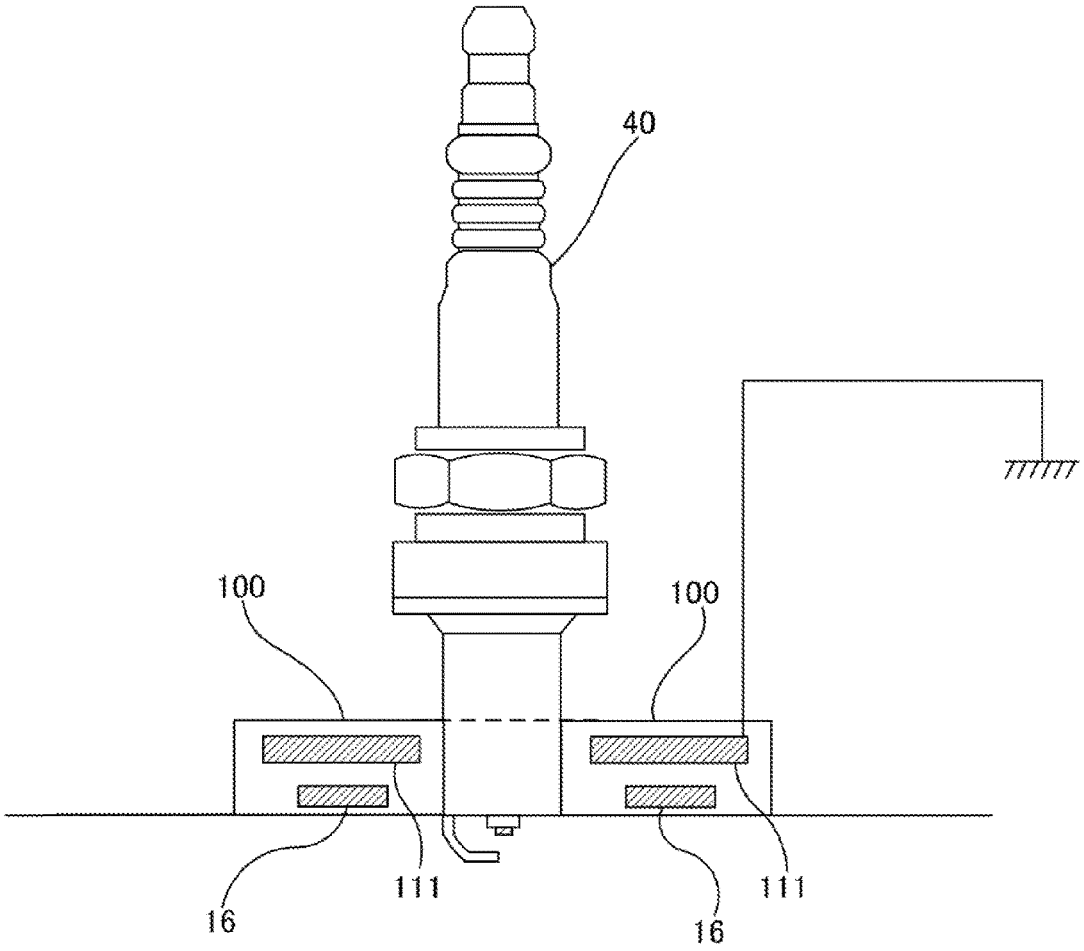
FIG. 4 is a vertical cross sectional view of an insulating member according to the embodiment.
Figure 5:
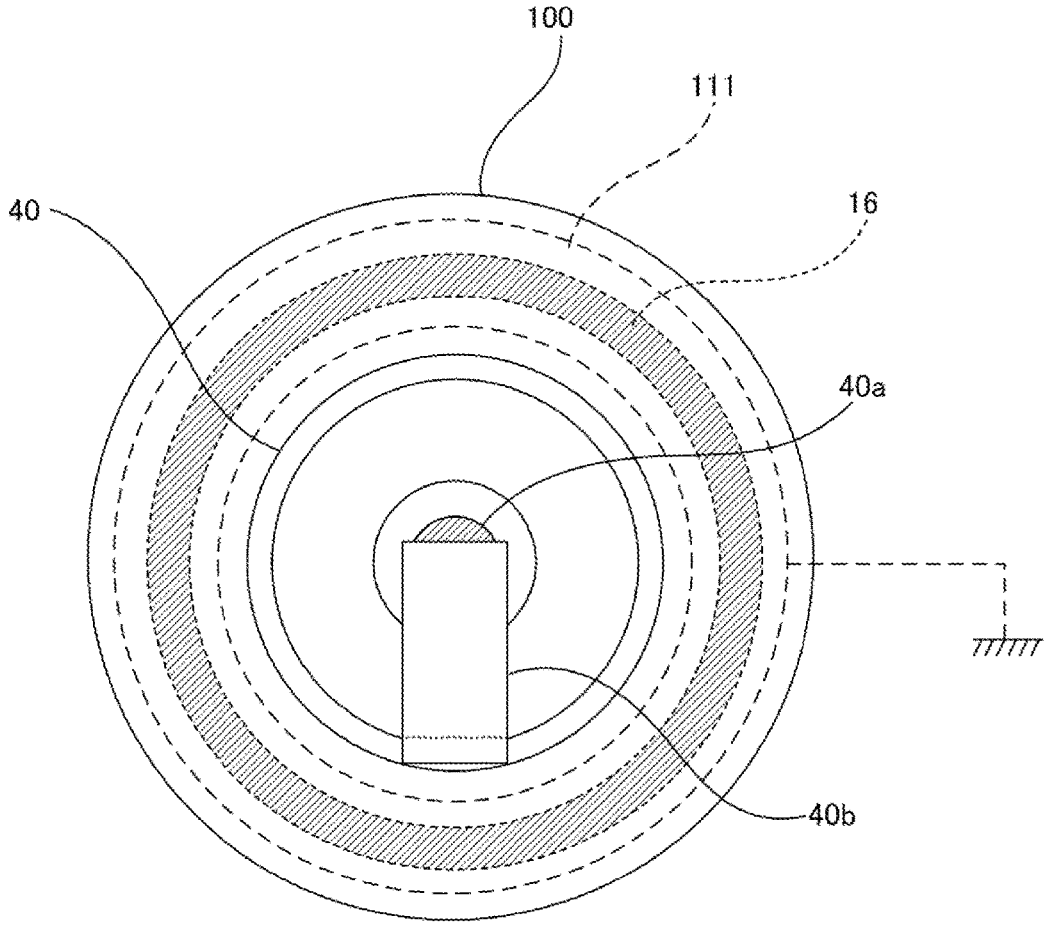
FIG. 5 is a front view of the insulating member according to the embodiment viewed from a side of the combustion chamber.

As shown in FIG. 4, the emission antenna 16 is provided in a ring-like shaped insulating member 100 provided on a ceiling surface 51 of the combustion chamber 20. The emission antenna 16 is embedded in the insulating member 100. As shown in FIG. 5, the emission antenna 16 is formed in a ring-like shape so as to surround the tip end part of the ignition plug 40, in front view of the ceiling surface 51 of the combustion chamber 20. The emission antenna 16 may be formed in a C-letter shape, in front view of the ceiling surface 51 of the combustion chamber 20.

Along with the emission antenna 16, a ground conductor 111 in a plate-like shape is embedded in the insulating member 100. The ground conductor 111 is grounded in a manner of being electrically connected to the cylinder head 22 or the like. The ground conductor 111 is formed, for example, in a C-letter shape. The ground conductor 111 and the emission antenna 16 are provided inside of the insulating member 100 and are spaced apart from each other. The ground conductor 111 is provided along the emission antenna 16.

A length in a circumference direction (a length of a center circumferential line extending between an inner circumference and an outer circumference) of the emission antenna 16 is configured to be equal to a half wavelength of the microwave emitted from the emission antenna 16. The emission antenna 16 is electrically connected to the output terminal of the electromagnetic wave switch 32 via a transmission line 33 of the microwave which is embedded in the cylinder head 22. The transmission line 33 is inserted in an opening of the C-letter shaped ground conductor 111 and is electrically connected to the emission antenna 16.

Figure 6:
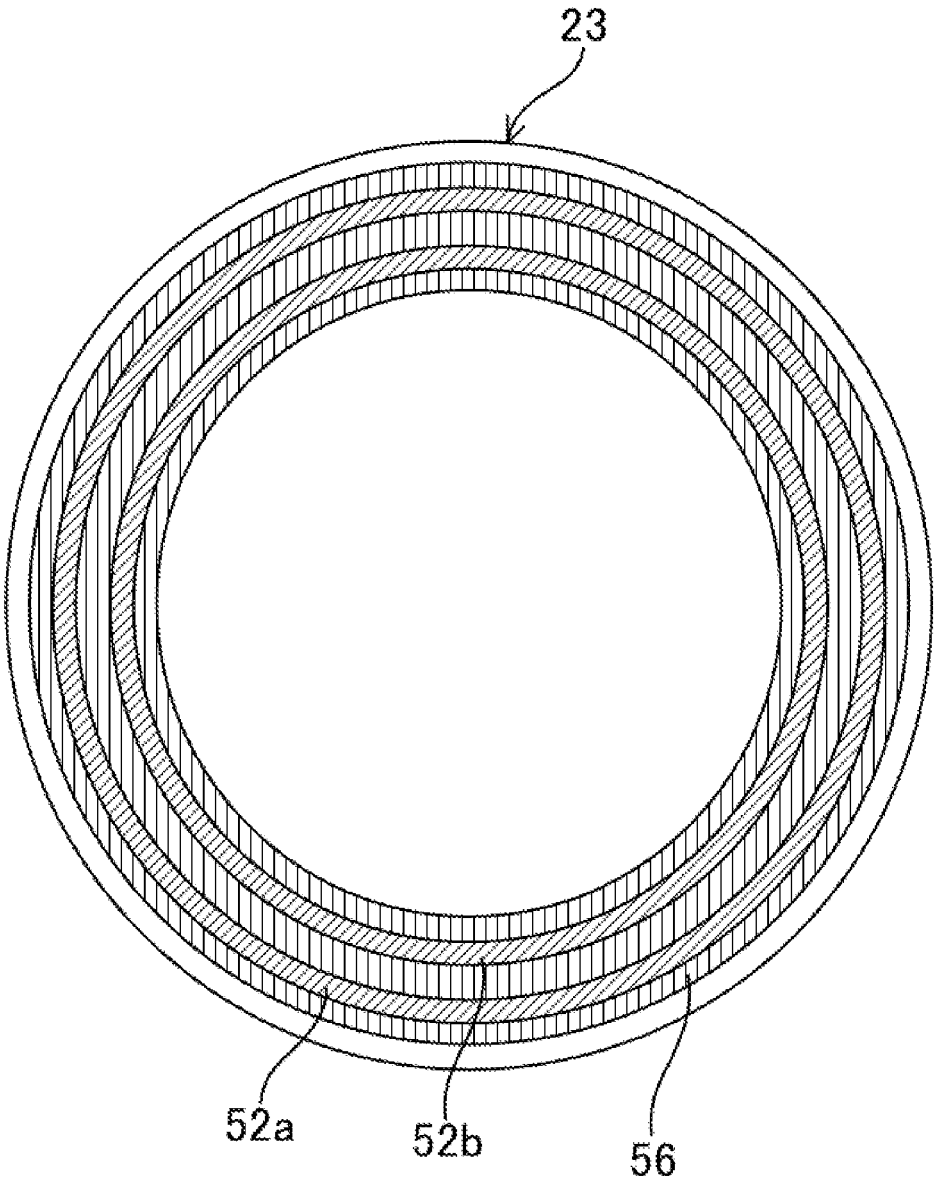
FIG. 6 is a front view of a top surface of a piston according to the embodiment.

In the internal combustion engine main body 11, a plurality of receiving antennae 52*a* and 52*b* are provided on the partitioning member that partitions the combustion chamber 20, and are adapted to resonate with the microwave emitted to the combustion chamber 20 from the electromagnetic wave emission device 13. According to the present embodiment, as shown in FIGS. 1 and 6, two receiving antennae 52*a* and 52*b* are provided on a top part of the piston 23. The receiving antennae 52*a* and 52*b* are each formed in a ring-like shape, and the center thereof coincides with a central axis of the piston 23.

The receiving antennae 52*a* and 52*b* are each provided on an area close to an outer circumference of the top part of the piston 23. From among the two receiving antennae 52*a* and 52*b*, a first receiving antenna 52*a* locates in the vicinity of the outer circumference of the piston 23, and a second receiving antenna 52*b* locates inside of the first receiving antenna 52*a*. Here, the area close to the outer circumference of the top part of the piston 23" is intended to mean an area outward of a center line extending between a center and the outer circumference of the top part of the piston 23. Hereinafter, a period when a flame passes through the area close to the outer circumference of the top surface of the piston 23 is referred to as a "latter half flame propagation period".

The receiving antennae 52*a* and 52*b* are provided on an insulation layer 56 formed on the top surface of the piston 23. The receiving antennae 52*a* and 52*b* are electrically insulated from the piston 23 by the insulation layer 56, and are provided in an electrically floating state.

<Operation of Control Device>

An operation of the control device 35 will be described hereinafter. During one combustion cycle for each combustion chamber 20, the control device 35 performs a first operation of instructing the ignition device 12 to ignite the air fuel mixture, and a second operation of instructing the electromagnetic wave emission device 13 to emit the microwave after the ignition of the air fuel mixture.

More particularly, the control device 35 performs the first operation at an ignition timing at which the piston 23 locates immediately before the compression top dead center. The control device 35 outputs the ignition signal as the first operation.

The ignition device 12, upon receiving the ignition signal, causes a spark discharge to occur at the discharge gap of the ignition plug 40, as described above. The spark discharge ignites the air fuel mixture. When the air fuel mixture is ignited, the flame spreads from an ignition location of the air fuel mixture at a central part of the combustion chamber 20 toward a wall surface of the cylinder 24.

The control device 35 performs the second operation after the ignition of the air fuel mixture, for example, at a start timing of the latter half flame propagation period. The control device 35 outputs the electromagnetic wave drive signal as the second operation.

The electromagnetic wave generation device 13, upon receiving the electromagnetic wave drive signal, repeatedly emits the microwave pulse from the emission antenna 16, as described above. The microwave pulse is repeatedly emitted over the latter half flame propagation period. An output timing and a pulse width of the electromagnetic wave drive signal are configured such that the microwave pulse is repeatedly emitted over the period in which the flame passes through the area close to the outer circumference of the top surface of the piston 23.

The microwave pulse resonates with each receiving antenna 52. In the area close to the outer circumference of the combustion chamber 20, on which the two receiving antennae 52 are provided, a strong electric field region having an electric field relatively strong in intensity in the combustion chamber 20 is formed over the latter half flame propagation period. The flame, while passing through the strong electric field region, receives energy of the microwave and increases in propagation speed.

In a case in which the microwave energy is high, microwave plasma is generated in the strong electric field region. In a region where the microwave plasma is generated, active species such as OH radicals are generated. The flame passing through the strong electric field region increases in propagation speed owing to the active species.

<Effect of Embodiment>

According to the present embodiment, since the ground conductor 111 is provided in the insulating member 100, it is possible to effectively emit the electromagnetic wave to the combustion chamber 20 from the emission antenna 16.

<Modified Example of Embodiment>

Figure 7:
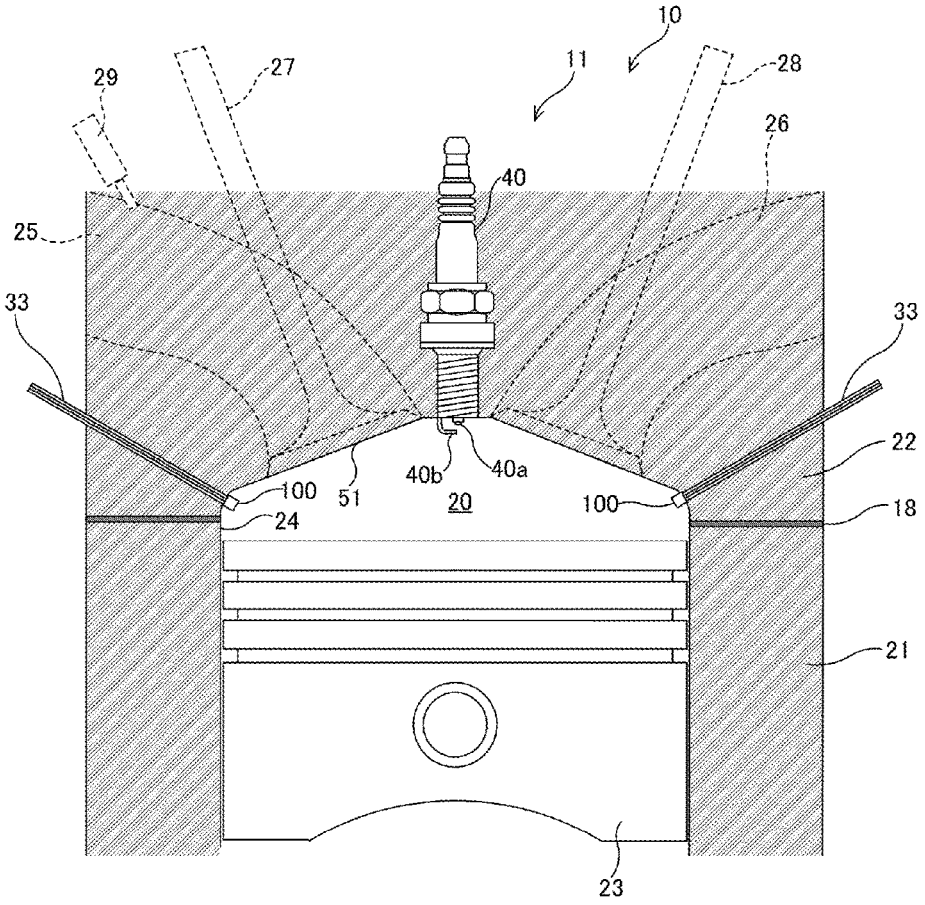
FIG. 7 is a vertical cross sectional view of an internal combustion engine according to a modified example of the embodiment.
Figure 8:
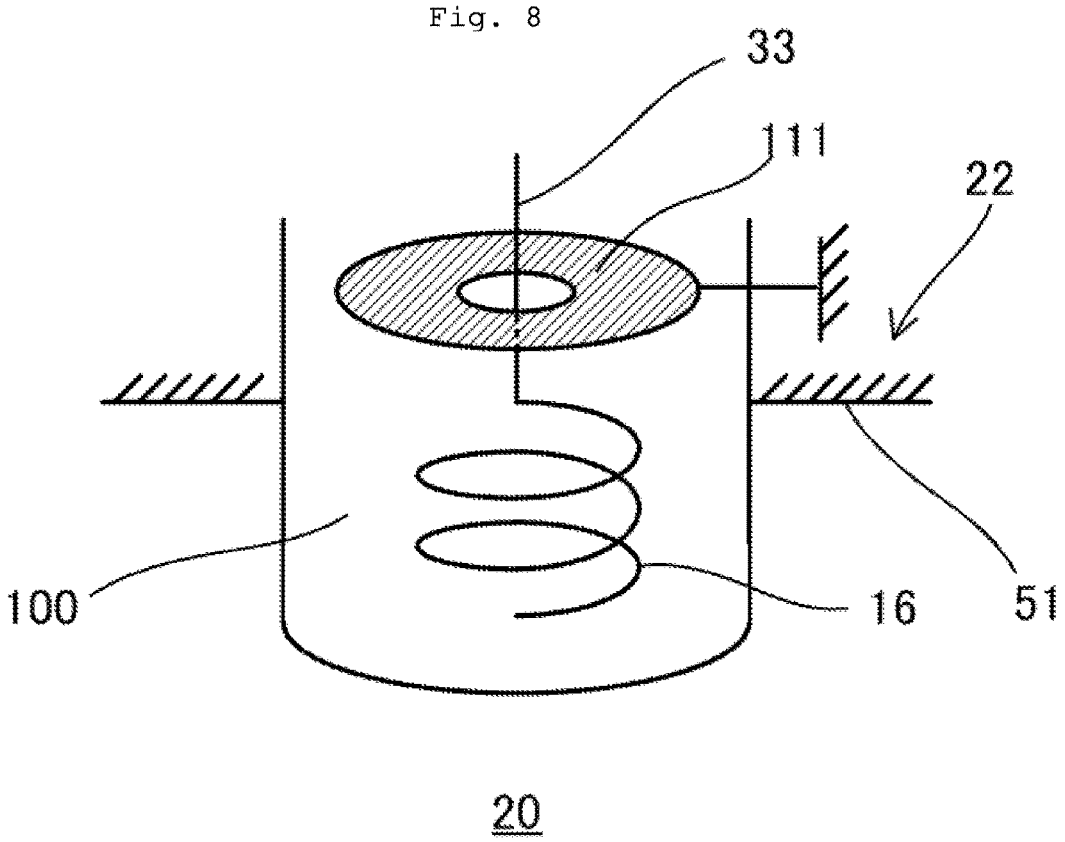
FIG. 8 is a schematic configuration diagram of an emission antenna according to the modified example of the embodiment.

According to the modified example of the embodiment, as shown in FIG. 7, the emission antenna 16 is provided in an area close to an outer circumference of the ceiling surface 51 of the combustion chamber 20. The emission antenna 16 is protruded from the ceiling surface 51 of the combustion chamber 20. As shown in FIG. 8, the emission antenna 16 is formed in a helical shape, and is embedded in an insulating member 100. A length of the emission antenna 16 is equal to a quarter wavelength of the microwave on the emission antenna 16. The emission antenna 16 is electrically connected to the output terminal of the electromagnetic wave switch 32 via a transmission line 33 of the microwave embedded in the cylinder head 22.

According to the modified example of the embodiment, a ground conductor 111 in a shape of a ring-like plate is embedded in a pillar-like shaped insulating member 100 in which the emission antenna 16 is provided. The transmission line 33 is inserted inside of the ground conductor 111. The ground conductor 111 is arranged close to the emission antenna 16. According to the modified example of the embodiment, the ground conductor 111 is provided so that energy of the microwave emitted to the combustion chamber 20 from the emission antenna 16 is increased.

INDUSTRIAL APPLICABILITY

The present invention is useful in relation to an internal combustion engine that promotes combustion of an air fuel mixture utilizing an electromagnetic wave.

EXPLANATION OF REFERENCE NUMERALS

10 Internal Combustion Engine
11 Internal Combustion Engine Main Body
13 Electromagnetic Wave Emission Device
16 Emission Antenna
20 Combustion Chamber
100 Insulating Member
111 Ground Conductor

What is claimed is:

1. An internal combustion engine comprising an internal combustion engine main body formed with a combustion chamber; an ignition plug for igniting an air fuel mixture; and an electromagnetic wave emission device configured to emit a microwave to the combustion chamber from an emission antenna, the internal combustion engine igniting the air fuel mixture with the ignition plug and promoting combustion of the air fuel mixture by way of the microwave emitted to the combustion chamber, wherein the emission antenna is provided in an insulating member provided on a ceiling surface in the combustion chamber, and extends along the ceiling surface, an electrically-grounded ground conductor is provided in the insulating member on a side opposite to the combustion chamber in relation to the emission antenna, the emission antenna or the electrically-grounded ground conductor is embedded in the insulating member as to be enclosed by the insulating member, and the emission antenna is formed in a ring shape or a C-letter shape surrounding a tip end part of the ignition plug.

2. An internal combustion engine comprising:

an internal combustion engine main body formed with a combustion chamber;

an ignition plug that ignites an air fuel mixture; and an electromagnetic wave emission device configured to emit a microwave to the combustion chamber from an emission antenna, the internal combustion engine igniting the air fuel mixture with the ignition plug and promoting combustion of the air fuel mixture by way of the microwave emitted to the combustion chamber, wherein the emission antenna is provided in an insulating member provided on a ceiling surface in the combustion chamber and is formed in a helical shape, an electrically-grounded ground conductor is provided in the insulating member on a side opposite to the combustion chamber in relation to the emission antenna, and the emission antenna or the electrically-grounded ground conductor is embedded in the insulating member as to be enclosed by the insulating member.

3. The internal combustion engine according to claim 1, wherein each of the emission antenna and the electrically-grounded ground conductor is embedded in the insulating member.

4. The internal combustion engine according to claim 1, wherein the electrically-grounded ground conductor is formed in a ring shape or a C-letter shape surrounding a tip end part of the ignition plug.

5. The internal combustion engine according to claim 1, wherein each of the emission antenna and the electrically-grounded ground conductor is a plate-shaped member that is formed in the ring shape or the C-letter shape.

6. The internal combustion engine according to claim 2, wherein each of the emission antenna and the electrically-grounded ground conductor is embedded in the insulating member.

* * * * *